US010655888B2

(12) United States Patent
Mohideen et al.

(10) Patent No.: US 10,655,888 B2
(45) Date of Patent: May 19, 2020

(54) MODULAR RACK FOR CLIMATE CONTROL SYSTEM

(71) Applicant: Heatcraft Refrigeration Products LLC, Stone Mountain, GA (US)

(72) Inventors: Abdul Kader Peer Mohideen, Chennai (IN); Sandesh Ramaswamy, Channarayapatana (IN); Vinoth Rajendran, Kallakurichi (IN); Janakiraman Kuppuswamy, Chennai (IN); Ganesh Thokur, Chennai (IN); Omkar Usturge, Chennai (IN); Poly Joseph, Chennai (IN)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 795 days.

(21) Appl. No.: 15/063,717

(22) Filed: Mar. 8, 2016

(65) Prior Publication Data

US 2017/0261227 A1 Sep. 14, 2017

(51) Int. Cl.
*F25D 23/12* (2006.01)
*F24F 13/32* (2006.01)
(Continued)

(52) U.S. Cl.
CPC ..... *F24F 13/32* (2013.01); *A47B 47/0091* (2013.01); *A47B 81/00* (2013.01);
(Continued)

(58) Field of Classification Search
CPC .. F24F 13/20; F24F 13/30; F24F 13/32; F24F 1/46; F24F 1/56; F24F 2221/36;
(Continued)

(56) References Cited

U.S. PATENT DOCUMENTS 4,378,680 A * 4/1983 Garland ..... F25C 5/10 62/278
6,688,712 B2 * 2/2004 Adams ..... E04B 1/3483 211/191

(Continued)

FOREIGN PATENT DOCUMENTS

EP 2 487 429 B1 2/2011

OTHER PUBLICATIONS

European Patent Office; Extended European Search Report, Application No. 17159709.9-1602, Ref. JL88077P.EPP. dated Jul. 7, 2017.

(Continued)

*Primary Examiner* — Henry T Crenshaw
*Assistant Examiner* — Kamran Tavakoldavani
(74) *Attorney, Agent, or Firm* — Baker Botts L.L.P.

(57) ABSTRACT

A system includes a high side heat exchanger, a flash tank, a compressor, and eight metal beams. Each of the metal beams extend in a linearly vertical direction. The eight metal beams define ten planar boundaries. The first, second, third, and fourth planar boundaries define a first space. The first, fifth, sixth, and seventh planar boundaries define a second space. The fifth, eighth, ninth, and tenth planar boundaries define a third space. The high side heat exchanger is contained entirely within the third space. The flash tank is contained entirely within the first space. The compressor is contained entirely within the second space.

15 Claims, 5 Drawing Sheets

(51) Int. Cl.

| | |
|---|---|
| ***F24F 1/46*** | (2011.01) |
| ***F24F 1/56*** | (2011.01) |
| ***F24F 13/20*** | (2006.01) |
| ***A47B 47/00*** | (2006.01) |
| ***A47B 81/00*** | (2006.01) |
| ***F25B 31/00*** | (2006.01) |
| ***F25B 43/00*** | (2006.01) |
| ***F25B 43/02*** | (2006.01) |

(52) U.S. Cl.
CPC ..... *F24F 1/46* (2013.01); *F24F 1/56* (2013.01); *F24F 13/20* (2013.01); *F25B 31/00* (2013.01); *F25B 43/003* (2013.01); *F25B 43/006* (2013.01); *F25B 43/02* (2013.01); *F24F 2221/36* (2013.01)

(58) Field of Classification Search
CPC ..... F24F 2013/202; F25B 2400/16; A47B 47/0091; A47B 81/00
See application file for complete search history.

(56) References Cited

U.S. PATENT DOCUMENTS

| | | | | |
|---|---|---|---|---|
| 9,677,796 | B2 * | 6/2017 | Schaeffer | F25B 41/003 |
| 2003/0011289 | A1 | 1/2003 | Adams et al. | |
| 2008/0000243 | A1 * | 1/2008 | Yoshimi | F24F 3/001 62/160 |
| 2008/0022713 | A1 * | 1/2008 | Jacobi | F24F 5/0017 62/434 |
| 2009/0241577 | A1 * | 10/2009 | Fukushima | F25B 13/00 62/259.1 |
| 2011/0192188 | A1 | 8/2011 | Nickey et al. | |
| 2011/0291533 | A1 | 12/2011 | McFarland | |
| 2012/0300391 | A1 * | 11/2012 | Keisling | H05K 7/20745 361/679.46 |
| 2015/0111487 | A1 | 4/2015 | Son et al. | |

OTHER PUBLICATIONS

European Patent Office, Communication pursuant to Article 94(3) EPC, Application No. 17159709.9, dated Aug. 28, 2019, 4 pages.

* cited by examiner

MODULAR RACK FOR CLIMATE CONTROL SYSTEM

TECHNICAL FIELD

This disclosure relates generally to a rack, specifically a modular rack for a climate control system.

BACKGROUND

Climate control systems are often arranged on metal racks. For example, a metal rack can be configured to accommodate a high side heat exchanger, a flash tank, a compressor, etc. The racks can be manufactured in various sizes to accommodate any number of components of the climate control systems.

SUMMARY OF THE DISCLOSURE

According to one embodiment, a system includes a high side heat exchanger, a flash tank, a load, a compressor, and eight metal beams. Each of the metal beams extend in a linearly vertical direction. The first and second metal beams define a first planar boundary. The second and third metal beams define a second planar boundary. The third and fourth metal beams define a third planar boundary. The fourth and first metal beams define a fourth planar boundary. The fifth and sixth metal beams define a fifth planar boundary. The first and fifth metal beams define a sixth planar boundary. The sixth and second metal beams define a seventh planar boundary. The sixth and seventh metal beams define an eighth planar boundary. The seventh and eighth metal beams define a ninth planar boundary. The eighth and fifth metal beams define a tenth planar boundary. The first, second, third, and fourth planar boundaries define a first space. The first, fifth, sixth, and seventh planar boundaries define a second space. The fifth, eighth, ninth, and tenth planar boundaries define a third space. The high side heat exchanger is configured to remove heat from a refrigerant and is contained entirely within the third space. The flash tank is configured to store the refrigerant from the high side heat exchanger and is contained entirely within the first space. The load is configured to use the refrigerant from the flash tank to remove heat from a space proximate the load. The compressor is configured to compress the refrigerant from the load and to send the refrigerant to the high side heat exchanger. The compressor is contained entirely within the second space.

According to another embodiment, a method includes storing, by a flash tank, a refrigerant. The flash tank is contained entirely within a first space. The method also includes compressing, by a compressor, the refrigerant. The compressor is contained entirely within a second space. The method further includes removing, by the high side heat exchanger, heat from the refrigerant. The high side heat exchanger is contained entirely within a third space. A first metal beam and a second metal beam define a first planar boundary. The second metal beam and a third metal beam define a second planar boundary. The third metal beam and a fourth metal beam define a third planar boundary. The fourth metal beam and the first metal beam define a fourth planar boundary. A fifth metal beam and a sixth metal beam define a fifth planar boundary. The first metal beam and the fifth metal beam define a sixth planar boundary. The sixth metal beam and the second metal beam define a seventh planar boundary. The sixth metal beam and a seventh metal beam define an eighth planar boundary. The seventh metal beam and an eighth metal beam defining a ninth planar boundary. The eighth metal beam and the fifth metal beam define a tenth planar boundary. The first, second, third, and fourth planar boundaries define the first space. The first, fifth, sixth, and seventh planar boundaries define the second space. The fifth, eighth, ninth, and tenth planar boundaries define the third space. Each of the first, second, third, fourth, fifth, sixth, seventh, and eighth metal beams extending in a linearly vertical direction.

According to yet another embodiment, a system includes an arrangement of eight metal beams. Each of the metal beams extends in a linearly vertical direction. The first and second metal beams define a first planar boundary. The second and third metal beams define a second planar boundary. The third and fourth metal beams define a third planar boundary. The fourth and first metal beams defining a fourth planar boundary. The fifth and sixth metal beams define a fifth planar boundary. The first and fifth metal beams define a sixth planar boundary. The sixth and second metal beams define a seventh planar boundary. The sixth and seventh metal beams define an eighth planar boundary. The seventh and eighth metal beams define a ninth planar boundary. The eighth and fifth metal beams define a tenth planar boundary. The first, second, third, and fourth planar boundaries define a first space. The first, second, third, and fourth metal beams are arranged such that a flash tank configured to store a refrigerant is contained entirely within the first space. The first, fifth, sixth, and seventh planar boundaries define a second space. The first, second, fifth, and sixth metal beams are arranged such that a compressor configured to compress the refrigerant is contained entirely within the second space. The fifth, eighth, ninth, and tenth planar boundaries define a third space. The fifth, sixth, seventh, and eighth metal beams are arranged such that a high side heat exchanger configured to remove heat from the refrigerant is contained entirely within the third space.

Certain embodiments may provide one or more technical advantages. For example, an embodiment allows for certain stages of a climate control system to be removed and/or replaced without affecting the configuration of the other stages of the climate control system. As another example, an embodiment allows for components to be added to a climate control system without needing a new metal rack to be manufactured. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
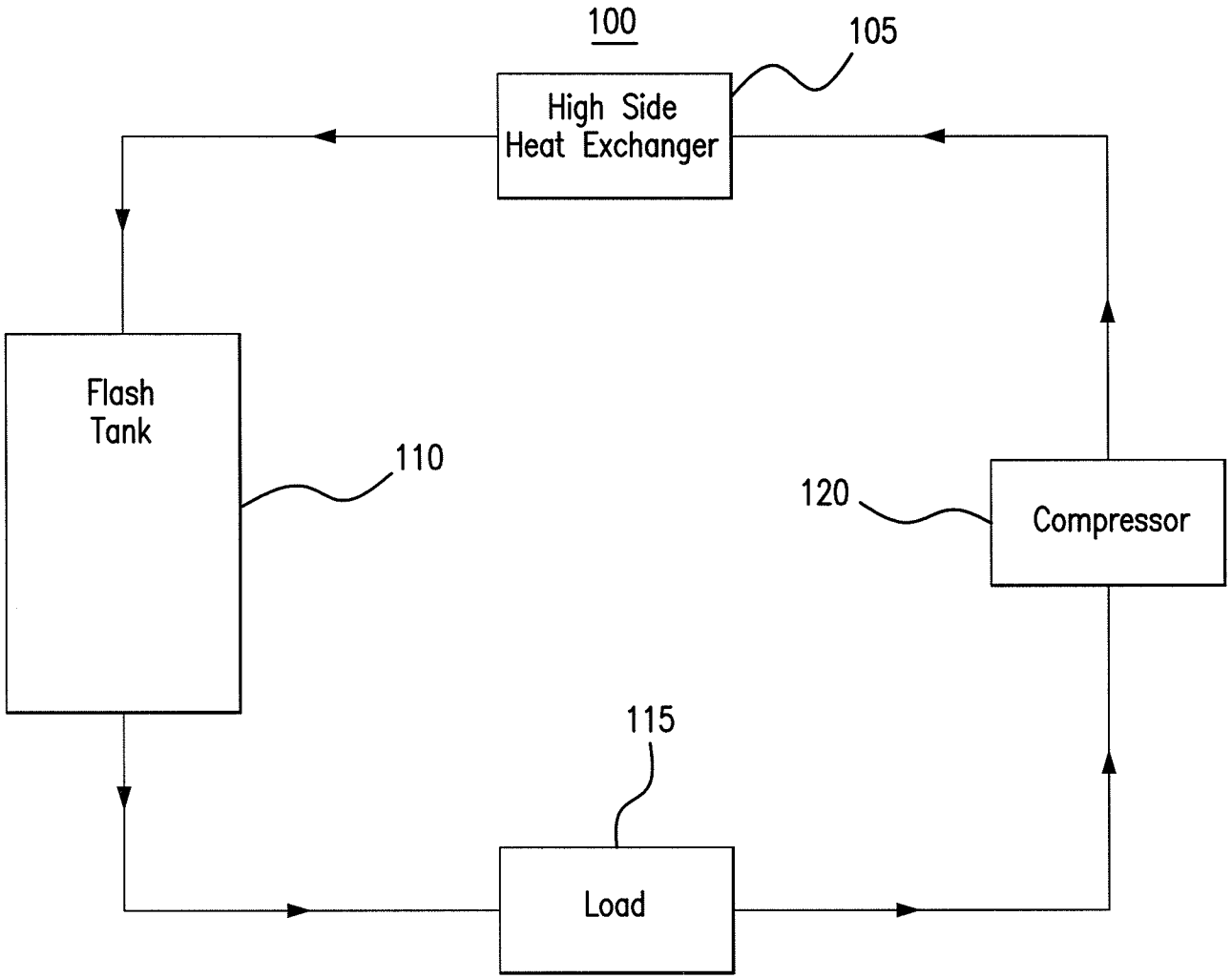
FIG. 1 illustrates an example climate control system.
Figure 2A:
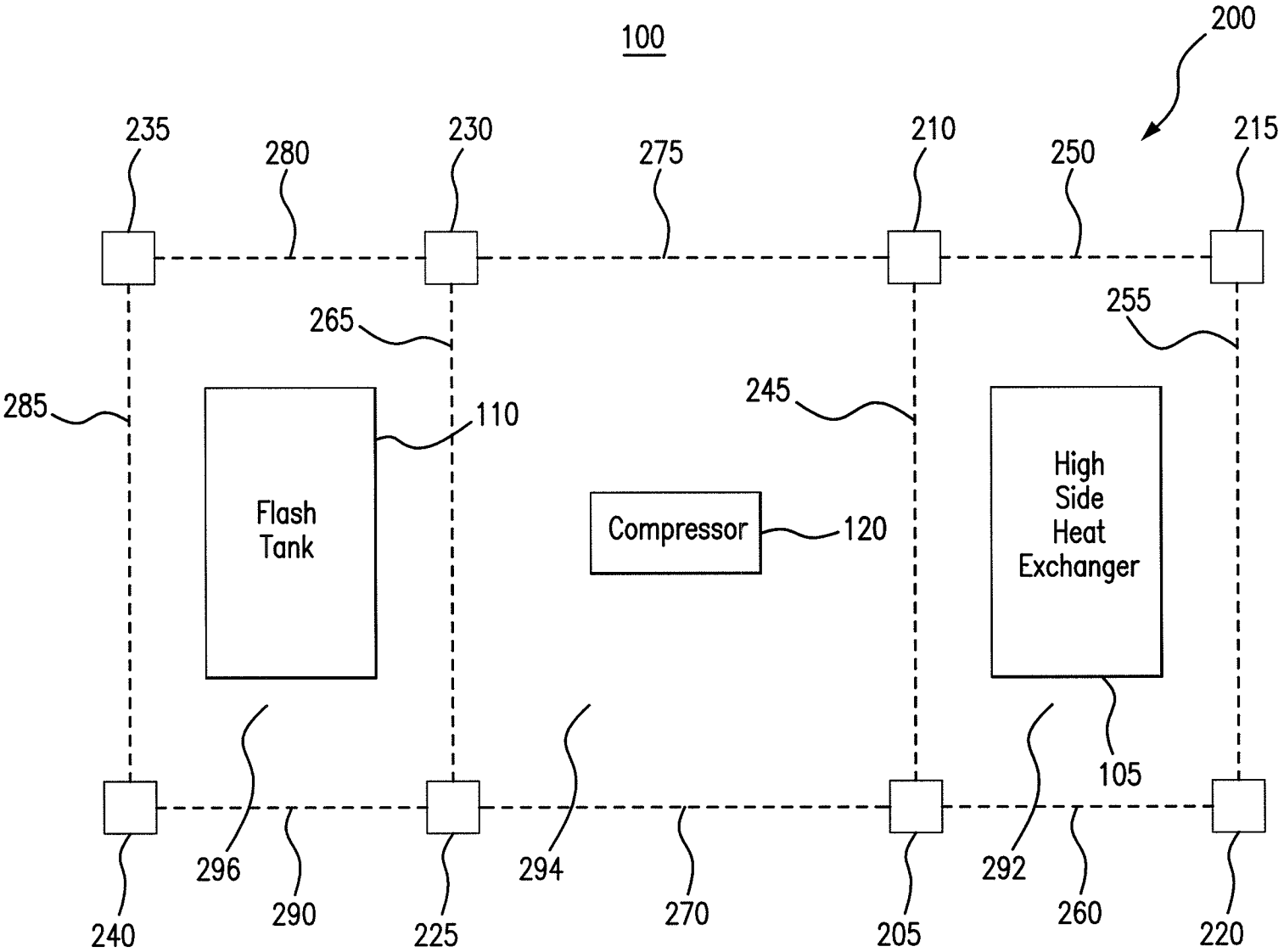
FIG. 2A illustrates a top-down view of the example climate control system of FIG. 1 arranged in a modular rack.
Figure 2B:
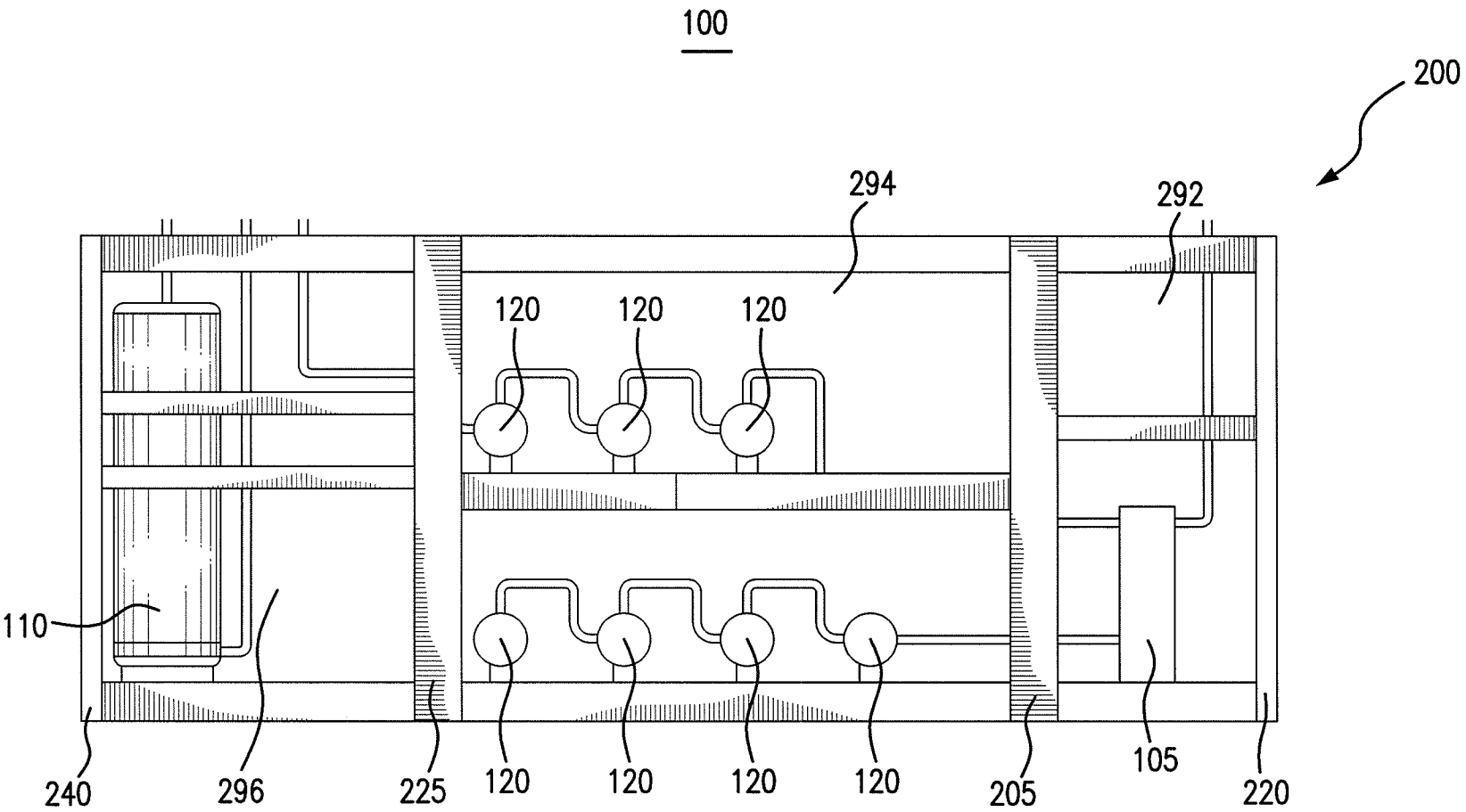
FIG. 2B illustrates a frontal view of the example climate control system of FIG. 1 arranged in a modular rack.
Figure 2C:
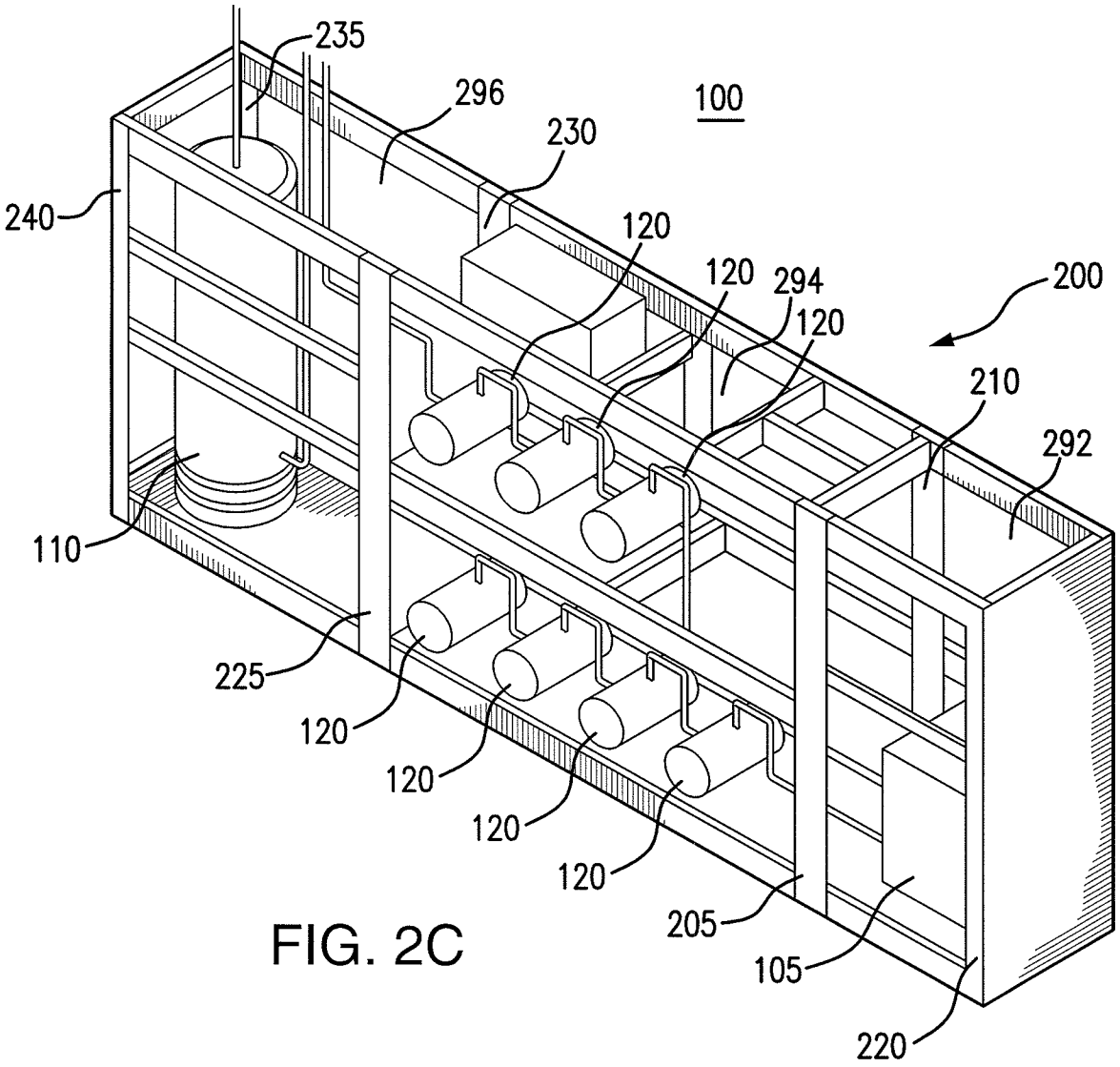
FIG. 2C illustrates an isometric view of the example climate control system of FIG. 1 arranged in a modular rack.
Figure 3:
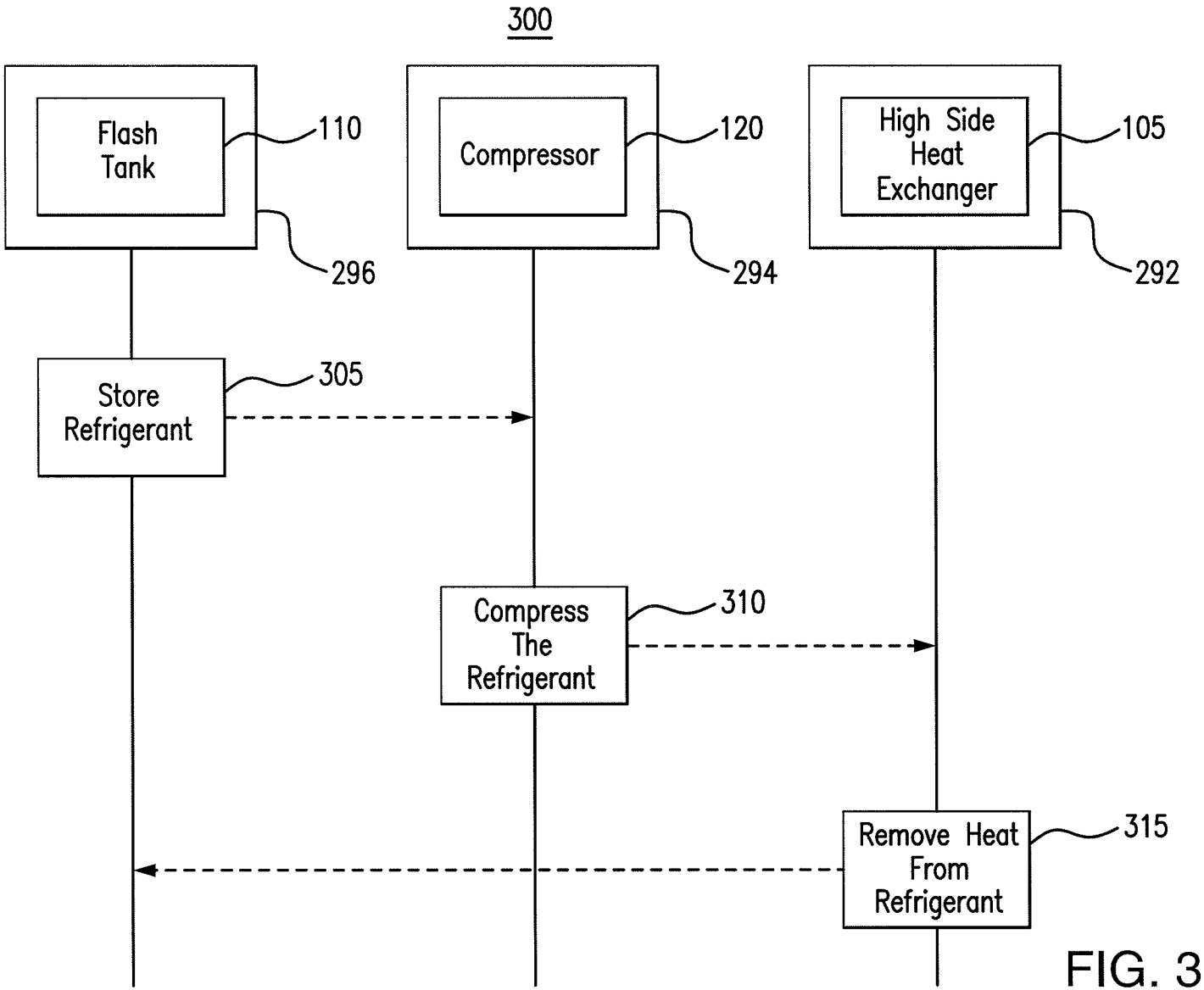
FIG. 3 is a flowchart illustrating a method of operating the example climate control system of FIG. 1 arranged in a modular rack.

Embodiments of the present disclosure and its advantages are best understood by referring to FIGS. 1 through 3 of the drawings, like numerals being used for like and corresponding parts of the various drawings.

Climate control systems are often arranged on metal racks. For example, a metal rack can be configured to accommodate a high side heat exchanger, a flash tank, a compressor and other various components of a climate control system. The rack can be manufactured in various sizes to accommodate any number of components of the climate control system. The components of the climate control system can then be mounted onto the metal rack. The metal rack can then be placed in a closet or room where the climate control system is stored.

The metal rack is typically manufactured to accommodate the particular needs of a climate control system. For example, if a climate control system utilizes only two compressors, then the metal rack can be manufactured with enough space for two compressors. As another example, if a climate control system utilizes six compressors, then the metal rack can be manufactured with enough space to accommodate six compressors. As yet another example, if a climate control system utilizes two flash tanks, then the rack can be manufactured to accommodate two flash tanks. Therefore, the metal racks can be manufactured to suit the needs of any climate control system.

This type of manufacture of metal racks presents a challenge when the climate control system needs to be modified. In such instances, the manufactured rack may no longer be suitable for the modified climate control system. As a result, a new rack may need to be manufactured to accommodate the modified climate control system. For example, if compressors need to be added to an existing climate control system, the metal rack for that climate control system may not be large enough to accommodate the additional compressors. As a result, a new, larger rack may need to be manufactured to accommodate the modified climate control system. As another example, if a flash tank or a high side heat exchanger of the climate control system needed to be replaced, the rack may not be able to accommodate the new flash tank or the new high side heat exchanger, especially if the new flash tank or high side heat exchanger was made by a different manufacturer than the original flash tank or high side heat exchanger. In this instance, the metal rack will need to be remanufactured to accommodate the modified climate control system.

This disclosure contemplates a modular climate control system arranged in a modular metal rack that allows for portions of the climate control system to be modified without having to remanufacture the entire metal rack. The metal rack sections off different portions of the climate control system. Each section of the metal rack can be expanded and/or modified without affecting the configuration of the other sections of the metal rack. In this manner, the metal rack can be modified to accommodate any modifications to the climate control system without having to remanufacture the entire rack.

In particular embodiments, by using the modular climate control system certain stages of the climate control system can be removed and/or replaced without affecting the configuration of the other stages of the climate control system. In some embodiments, the modular climate control system allows for components to be added to the climate control system without needing a new metal rack to be manufactured. The modular climate control system will be discussed in more detail using FIGS. 1 through 3. FIG. 1 describes the components of the climate control system. FIGS. 2A through 2C describe the configuration of the metal rack and the climate control system. FIG. 3 describes the operation of the modular climate control system.

FIG. 1 illustrates an example climate control system 100. As illustrated in FIG. 1, system 100 includes a high side heat exchanger 105, a flash tank 110, a load 115, and a compressor 120. The components of system 100 cycle a refrigerant through system 100 to cool a space.

High side heat exchanger 105 removes heat from the refrigerant. When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools the refrigerant but the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Flash tank 110 stores refrigerant received from high side heat exchanger 105. This disclosure contemplates flash tank 110 storing refrigerant in any state such as, for example, a liquid state and/or a gaseous state. Refrigerant leaving flash tank 110 is fed to load 115. This disclosure contemplates system 100 including any number of flash tanks 110. Flash tank 110 is referred to as a receiving vessel in certain embodiments.

Load 115 receives the refrigerant from flash tank 110. Load 115 cycles the refrigerant to cool a space proximate load 115. For example, load 115 may use the refrigerant to cool air proximate load 115. Then load 115 may circulate the cooled air using a fan to cool a larger space.

Compressor 120 compresses refrigerant received from load 115. This disclosure contemplates system 100 including any number of compressors 120. Compressor 120 may be configured to increase the pressure of the refrigerant. As a result, the heat in the refrigerant may become concentrated and the refrigerant may become a high pressure gas. Compressor 120 may send the compressed refrigerant to high side heat exchanger 105.

This disclosure contemplates climate control system 100 including any number of components. For example, climate control system 100 may include one or more high side heat exchangers 105, flash tanks 110, loads 115, and/or compressors 120. Climate control system 100 may also include piping that controls the flow of the refrigerant through system 100. Climate control system 100 may further include other components typically found in a climate control system such as, for example, a filter drier, an oil separator, and an accumulator. This disclosure contemplates climate control system 100 including any appropriate component.

FIGS. 2A through 2C illustrate climate control system 100 arranged in a modular metal rack. By arranging climate control system 100 in a modular metal rack, components of climate control system 100 may be modified and/or replaced without having to remanufacture the entire metal rack. Furthermore, the modular metal rack may be expanded without having to remanufacture the entire metal rack.

FIG. 2A illustrates a top-down view of the example climate control system 100 of FIG. 1 arranged in a modular rack 200. As illustrated, rack 200 includes eight metal beams 205, 210, 215, 220, 225, 230, 235 and 240. Metal beams 205, 210, 215, 220, 225, 230, 235 and 240 establish sections of rack 200 in which components of climate control system 100 may be placed. Certain components of system 100 may not be located on rack 200. For example, load 115 may be positioned within a portion of a structure that needs to be cooled (e.g. a refrigeration unit or a room). In particular embodiments, by using rack 200, components of climate control system 100 may be modified and/or replaced without modifying the entire rack 200.

Metal beams 205, 210, 215 and 220 may be arranged to define planar boundaries 245, 250, 255 and 260. Each of planar boundaries 245, 250, 255 and 260 have edges defined by metal beams 205, 210, 215 and 220. Planar boundaries 245, 250, 255 and 260 define a space 292. Metal beams 205, 210, 225 and 230 define planar boundaries 245, 265, 270 and 275. Each of planar boundaries 245, 265, 270 and 275 have edges defined by metal beams 205, 210, 225 and 230. Planar boundaries 245, 265, 270 and 275 define a space 294. Metal beams 225, 230, 235 and 240 define planar boundaries 265, 280, 285 and 290. Planar boundaries 265, 280, 285 and 290 have edges defined by metal beams 225, 230, 235 and 240. Planar boundaries 265, 280, 285 and 290 define a space 296. Each of metal beams 205, 210, 215, 220, 225, 230, 235, and 240 are arranged in a linearly vertical direction.

Spaces 292, 294 and 296 may be used to segment different components of climate control system 100. For example, space 292 may contain high side heat exchanger 105, space 294 may contain compressor 120, and space 296 may contain flash tank 110. In this example, high side heat exchanger 105 is contained entirely within space 292, compressor 120 is contained entirely within space 294, and flash tank 110 is contained entirely within space 296. The various components of system 200 may be coupled together with piping that crosses the planar boundaries.

Rack 200 includes other metal beams not illustrated in FIG. 2A. For example, rack 200 includes metal beams that couple metal beam 205 to metal beam 210, metal beams that couple metal beam 210 to metal beam 215, metal beams that couple metal beam 215 to metal beam 220, metal beams that couple metal beam 205 to metal beam 225, metal beams that couple metal beam 210 to metal beam 230, metal beams that couple metal beam 225 to metal beam 230, metal beams that couple metal beam 230 to metal beam 235, metal beams that couple metal beam 235 to metal beam 240, and metal beams that couple metal beam 225 to metal beam 240.

By arranging climate control system 100 in rack 200, components of system 100 may be modified and/or replaced without having to remanufacture rack 200. For example, an additional flash tank may be added to system 100 by expanding space 296. In the same way, compressors 120 and high side heat exchangers 105 may be added and/or replaced in system 100 without having to remanufacture the entire rack 200.

In particular embodiments, climate control system 100 may include additional components such as a filter drier, an oil separator, and an accumulator. The filter drier may be arranged in space 296 such that the filter drier is accessible and removable through planar boundary 290. The oil separator may be coupled to one or more compressors 120, and the accumulator may be coupled to one or more compressors 120. The oil separator may be contained entirely within space 294. The accumulator may be contained entirely within space 296.

Climate control system 100 may include more than one flash tank 110. The second flash tank 110 may also store refrigerant from high side heat exchanger 105. Space 296 may be expanded to accommodate second flash tank 110 such that second flash tank 110 and flash tank 110 are contained entirely within space 296.

In some embodiments, compressors 120 may be added to climate control system 100. The additional compressors may be chained together with the original compressor 120. In this manner, the additional compressors 120 may further compress the refrigerant from the original compressor 120. The additional compressors 120 may send the compressed refrigerant to high side heat exchanger 105. Space 294 may be expanded to accommodate the additional compressors such that the additional compressors are all contained entirely within space 294. Each of these compressors and the original compressor 120 may be arranged such that they are each accessible and removable through planar boundary 270.

FIG. 2B illustrates a frontal view of the example climate control system 100 of FIG. 1 arranged in a modular rack 200. As illustrated in FIG. 2B, flash tank 110 is contained entirely within space 296, compressors 120 are contained entirely within space 294, and high side heat exchanger 105 is contained entirely within space 292. Metal beams 240, 255, 205 and 220 establish some of the boundaries that define spaces 292, 294 and 296.

This disclosure contemplates high side heat exchanger 105 coupling, through piping, to a heat removal unit. The heat removal unit may further remove heat from the refrigerant in system 100. The heat removal unit may be located on the exterior of a building or on the ceiling of the building. The heat removal unit may discharge any removed heat into the air outside the building. The heat removal unit may then send the refrigerant to flash tank 110.

In particular embodiments, climate control system 100 includes a heat reclaim unit. The heat reclaim unit may be coupled to metal beams 220 and 215. The heat reclaim unit provides ventilated air that improves the efficiency of climate control system 100. For example, the heat reclaim unit may maintain the humidity and/or temperature of a space using ventilated air without having to operate climate control system 100.

As illustrated in FIG. 2B, each of the components of climate control system 100 is accessible and/or removable through the front of rack 200. For example, flash tank 110, compressors 120 and high side heat exchanger 105 are each accessible and/or removable from the front of rack 200. Additional components of system 100 may also be accessible and/or removable from the front of rack 200.

FIG. 2C illustrates an isometric view of the example climate control system 100 of FIG. 1 arranged in a modular rack 200. As illustrated in FIG. 2C, each of metal beams 205, 210, 220, 225, 230, 235 and 240 define boundaries for spaces 292, 294 and 296. High side heat exchanger 105 is contained entirely within space 292, each compressor 120 is contained entirely within space 294, and flash tank 110 is contained entirely within space 296. Rack 200 may include additional metal beams that couple together metal beams 205, 210, 220, 225, 230, 235 and 240. By coupling together metal beams 205, 210, 220, 225, 230, 235 and 240, the structure of metal rack 200 is stabilized. The lengths of these additional metal beams may be adjusted and/or modified to accommodate additional or different components of climate control system 100. For example, the metal beams coupling metal beams 225 and 240 and the metal beams coupling metal beams 230 and 235 may be lengthened to increase the size of space 296. When the size of space 296 is increased, an additional flash tank 110 may be added to climate control system 100. In this manner, components may be added to climate control system 100 without needing to modify other portions of system 100. Using the previous example, adding the extra flash tank 110 did not affect how compressors 120 and/or high side heat exchanger 105 were arranged in rack 200 nor did those portions of rack 200 need to be modified to accommodate the additional flash tank 110.

This disclosure contemplates the metal beams of rack 200 being coupled together using any appropriate coupling means, such as for example, huck bolts, pieces with bolt patterns, and/or other common and universal parts. To expand a section of rack 200, certain metal beams can be uncoupled and replaced with longer metal beams. For example, the metal beams coupling metal beams 230 and 235 and the metal beams coupling metal beams 225 and 240 can be uncoupled and replaced with longer beams to expand space 296. In this manner, rack 200 need not be remanufactured to expand space 296. Furthermore, none of the metal beams corresponding to spaces 292 and 294 are affected by the change to space 296.

In certain embodiments, arranging certain components of system 100 in particular sections of rack 200 improves accessibility to these components. For example, arranging each compressor 120 in space 294 and orientating each compressor 120 to face the same direction allows each compressor 120 to be accessible through a front surface of rack 200. This also allows each compressor 120 to be serviced and/or replaced through the same surface of rack 200.

FIG. 3 is a flowchart illustrating a method 300 of operating the example climate control system 100 of FIG. 1 arranged in a modular rack. As illustrated in FIG. 3, flash tank 110, compressor 120 and high side heat exchanger 105 may perform method 300. Flash tank 110 is contained entirely within space 296. Compressor 120 is contained entirely within space 294 and high side heat exchanger 105 is contained entirely within space 292.

Flash tank 110 may begin by storing a refrigerant in step 305. Then in step 310, compressor 120 may compress the refrigerant. Method 300 may conclude by high side heat exchanger 105 removing heat from the refrigerant in step 315.

Modifications, additions, or omissions may be made to method 300 depicted in FIG. 3. Method 300 may include more, fewer, or other steps. For example, steps may be performed in parallel or in any suitable order. While discussed as various components of climate control system 100 performing the steps, any suitable component or combination of components of system 100 may perform one or more steps of the method.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a first, second, third, and fourth metal beams, each of the first, second, third, and fourth metal beams extending in a linearly vertical direction, the first and second metal beams defining a first planar boundary, the second and third metal beams defining a second planar boundary, the third and fourth metal beams defining a third planar boundary, the fourth and first metal beams defining a fourth planar boundary;

a fifth, sixth, seventh, and eighth metal beams, each of the fifth, sixth, seventh, and eighth metal beams extending in a linearly vertical direction, the fifth and sixth metal beams defining a fifth planar boundary, the first and fifth metal beams defining a sixth planar boundary, the sixth and second metal beams defining a seventh planar boundary, the sixth and seventh metal beams defining an eighth planar boundary, the seventh and eighth metal beams defining a ninth planar boundary, the eighth and fifth metal beams defining a tenth planar boundary, wherein:

the first, second, third, and fourth planar boundaries define a first space;

the first, fifth, sixth, and seventh planar boundaries define a second space, the first space distinct from the second space; and the fifth, eighth, ninth, and tenth planar boundaries define a third space;

a high side heat exchanger configured to remove heat from a refrigerant, the high side heat exchanger contained entirely within the third space;

a flash tank configured to store the refrigerant from the high side heat exchanger, the flash tank contained entirely within the first space;

a load configured to use the refrigerant from the flash tank to remove heat from a space proximate the load; and a compressor configured to compress the refrigerant from the load and to send the refrigerant to the high side heat exchanger, the compressor contained entirely within the second space, the compressor is accessible and removeable through the sixth planar boundary.

2. The system of claim 1, further comprising an oil separator coupled to the compressor and an accumulator coupled to the compressor, the oil separator contained entirely within the second space, the accumulator contained entirely within the first space.

3. The system of claim 1, further comprising a second flash tank configured to store the refrigerant from the high side heat exchanger, the second flash tank contained entirely within the first space.

4. The system of claim 1, further comprising a second compressor configured to compress refrigerant from the compressor, the second compressor configured to send the refrigerant to the high side heat exchanger, the second compressor contained entirely within the second space.

5. The system of claim 1, further comprising a filter drier accessible and removable through the fourth planar boundary.

6. A method comprising:

storing, by a flash tank, a refrigerant, the flash tank contained entirely within a first space;

compressing, by a compressor, the refrigerant, the compressor contained entirely within a second space, the first space distinct from the second space;

removing, by the high side heat exchanger, heat from the refrigerant, the high side heat exchanger contained entirely within a third space, wherein:

a first metal beam and a second metal beam define a first planar boundary;

the second metal beam and a third metal beam define a second planar boundary;

the third metal beam and a fourth metal beam define a third planar boundary;

the fourth metal beam and the first metal beam define a fourth planar boundary;

a fifth metal beam and a sixth metal beam define a fifth planar boundary;

the first metal beam and the fifth metal beam define a sixth planar boundary, the compressor is accessible and removable through the sixth planar boundary;

the sixth metal beam and the second metal beam define a seventh planar boundary;

the sixth metal beam and a seventh metal beam define an eighth planar boundary;

the seventh metal beam and an eighth metal beam defining a ninth planar boundary;

the eighth metal beam and the fifth metal beam define a tenth planar boundary;

the first, second, third, and fourth planar boundaries define the first space;

the first, fifth, sixth, and seventh planar boundaries define the second space; and the fifth, eighth, ninth, and tenth planar boundaries define the third space; and each of the first, second, third, fourth, fifth, sixth, seventh, and eighth metal beams extending in a linearly vertical direction.

7. The method of claim 6, wherein an oil separator is coupled to the compressor and an accumulator is coupled to the compressor, the oil separator contained entirely within the second space, the accumulator contained entirely within the first space.

8. The method of claim 6, further comprising storing the refrigerant in a second flash tank contained entirely within the first space.

9. The method of claim 6, further comprising compressing, by a second compressor, the refrigerant from the compressor, the second compressor contained entirely within the second space.

10. The method of claim 6, wherein a filter drier is accessible and removable through the fourth planar boundary.

11. A system comprising:

a first, second, third, and fourth metal beams, each of the first, second, third, and fourth metal beams extending in a linearly vertical direction, the first and second metal beams defining a first planar boundary, the second and third metal beams defining a second planar boundary, the third and fourth metal beams defining a third planar boundary, the fourth and first metal beams defining a fourth planar boundary;

a fifth, sixth, seventh, and eighth metal beams, each of the fifth, sixth, seventh, and eighth metal beams extending in a linearly vertical direction, the fifth and sixth metal beams defining a fifth planar boundary, the first and fifth metal beams defining a sixth planar boundary, the sixth and second metal beams defining a seventh planar boundary, the sixth and seventh metal beams defining an eighth planar boundary, the seventh and eighth metal beams defining a ninth planar boundary, the eighth and fifth metal beams defining a tenth planar boundary, wherein:

the first, second, third, and fourth planar boundaries define a first space;

the first, second, third, and fourth metal beams are arranged such that a flash tank configured to store a refrigerant is contained entirely within the first space;

the first, fifth, sixth, and seventh planar boundaries define a second space, the first space distinct from the second space;

the first, second, fifth, and sixth metal beams are arranged such that a compressor configured to compress the refrigerant is contained entirely within the second space, the compressor is accessible and removable through the sixth planar boundary;

the fifth, eighth, ninth, and tenth planar boundaries define a third space; and the fifth, sixth, seventh, and eighth metal beams are arranged such that a high side heat exchanger configured to remove heat from the refrigerant is contained entirely within the third space.

12. The system of claim 11, further comprising an oil separator coupled to the compressor and an accumulator coupled to the compressor, the oil separator contained entirely within the second space, the accumulator contained entirely within the first space.

13. The system of claim 11, further comprising a second flash tank configured to store the refrigerant from the high side heat exchanger, the second flash tank contained entirely within the first space.

14. The system of claim 11, further comprising a second compressor configured to compress refrigerant from the compressor, the second compressor configured to send the refrigerant to the high side heat exchanger, the second compressor contained entirely within the second space.

15. The system of claim 11, further comprising a filter drier accessible and removable through the fourth planar boundary.

* * * * *